US010400344B2

(12) United States Patent
Grant et al.

(10) Patent No.: US 10,400,344 B2
(45) Date of Patent: Sep. 3, 2019

(54) APPARATUS FOR PROTECTION OF ANODES AND CATHODES IN A SYSTEM OF ELECTROLYSIS CELLS

(71) Applicant: OUTOTEC (FINLAND) OY, Espoo (FI)

(72) Inventors: Duncan Grant, Bristol (GB); Michael H. Barker, Pori (FI); Henri K. Virtanen, Pori (FI); Sönke Schmachtel, Pori (FI); Ari Rantala, Porvoo (FI); Lauri Nordlund, Espoo (FI)

(73) Assignee: OUTOTEC (FINLAND) OY, Espoo (FI)

( * ) Notice: Subject to any disclaimer, the term of this patent is extended or adjusted under 35 U.S.C. 154(b) by 486 days.

(21) Appl. No.: 14/895,694

(22) PCT Filed: May 30, 2014

(86) PCT No.: PCT/FI2014/050413
§ 371 (c)(1),
(2) Date: Dec. 3, 2015

(87) PCT Pub. No.: WO2014/195572
PCT Pub. Date: Dec. 11, 2014

(65) Prior Publication Data

US 2016/0138177 A1 May 19, 2016

(30) Foreign Application Priority Data

Jun. 5, 2013 (FI) ..... 20135626

(51) Int. Cl.
*C25C 7/06* (2006.01)

(52) U.S. Cl.
CPC ..... *C25C 7/06* (2013.01)

(58) Field of Classification Search
CPC ..... C25C 1/00–5/00; C25C 7/00; C25C 7/02; C25C 7/025; C25C 7/04; C25C 7/06; C25C 7/08; C25D 21/12
See application file for complete search history.

(56) References Cited

U.S. PATENT DOCUMENTS 2,508,523 A 5/1950 Krebs
2,834,728 A 5/1958 Gallone
(Continued)

FOREIGN PATENT DOCUMENTS

JP 2008-280564 A 11/2008
WO WO 2011/123896 A1 10/2011
(Continued)

OTHER PUBLICATIONS

International Search Report (PCT/ISA/210) dated Sep. 3, 2014, by the European Patent Office as the International Searching Authority for International Application No. PCT/FI2014/050413.
(Continued)

*Primary Examiner* — Maris R Kessel
*Assistant Examiner* — Joshua L Allen
(74) *Attorney, Agent, or Firm* — Buchanan, Ingersoll & Rooney PC

(57) ABSTRACT

Provided is an electrode assembly for electrolytic processing in an electrolysis cell comprising an electrode blade comprising a metallic hanger bar portion, a first lug for supporting the metallic hanger bar portion on a first power supply bar, an insulating piece connecting the metallic hanger bar portion to the first lug. The electrode assembly also comprises an electrical switch unit controlling electrical current supply between the first lug and the metallic hanger bar based on a control signal transmitted to a terminal of the electrical switch unit, a control unit configured to transmit the control signal to the terminal of the electrical switch unit,
(Continued)

and a power storage unit configured to supply power to the control unit, the power storage unit being charged from the first lug and the hanger bar when the electrical switch unit switches off electrical current supply between the first lug and the metallic hanger bar.

17 Claims, 9 Drawing Sheets

(56) References Cited

U.S. PATENT DOCUMENTS

| | | | | |
|---|---|---|---|---|
| 4,391,695 | A | 7/1983 | Koziol et al. | |
| 4,786,384 | A * | 11/1988 | Gerhardt | C02F 1/46109 205/758 |
| 6,398,939 | B1 | 6/2002 | Huens et al. | |
| 2005/0218001 | A1* | 10/2005 | You | C25B 15/02 205/89 |
| 2006/0213766 | A1 | 9/2006 | You | |
| 2008/0210552 | A1* | 9/2008 | Del Signore | C25B 9/06 204/228.6 |
| 2011/0054802 | A1* | 3/2011 | Rantala | C25C 7/06 702/22 |
| 2012/0160700 | A1* | 6/2012 | Wiedmeyer | C25C 3/34 205/477 |
| 2013/0126337 | A1 | 5/2013 | Grant | |

FOREIGN PATENT DOCUMENTS

| | | | | |
|---|---|---|---|---|
| WO | WO-2011123896 | A1 * | 10/2011 | C25C 7/06 |
| WO | WO 2012/020243 | A1 | 2/2012 | |
| WO | WO-2012020243 | A1 * | 2/2012 | C25C 7/00 |
| WO | WO 2012/087400 | A1 | 6/2012 | |
| WO | WO 2013/038352 | A1 | 3/2013 | |

OTHER PUBLICATIONS

International Preliminary Report on Patentability (PCT/IPEA/409) dated Jun. 19, 2015 for International Application No. PCT/FI2014/050413, (13 pages).

Search Report issued by the Finnish Patent and Registration Office in corresponding Finnish Patent Application No. 20135626 dated Jan. 29, 2014 (1 page).

* cited by examiner

Electrorefining

Electrowinning

APPARATUS FOR PROTECTION OF ANODES AND CATHODES IN A SYSTEM OF ELECTROLYSIS CELLS

FIELD OF THE INVENTION

The invention relates to the electrolytic processing of metals. Examples of electrolytic recovery of metals are electrorefining and electrowinning. The invention relates to an apparatus for protection of anodes and cathodes in a system of electrolysis cells.

BACKGROUND OF THE INVENTION

In electrorefining (ER) and electrowinning (EW) electrodes are immersed in an electrolyte and an electric current is passed between them. The anode is made positive and the cathode made negative so that an electric current passes through the electrolyte from anode to cathode.

In electrorefining (ER), the metal anode is soluble. That is to say that the metal enters into the electrolyte under the influence of the potential between the anode and cathode. For example, in the electrorefining of copper, the anode is made of copper and the copper enters the electrolyte from the anode. The metal, now in the electrolyte, is transported through the electrolyte to the cathode where it is deposited. The cathode may be of the same metal as the metal that is being deposited or it may be of a different metal. For example, in the electrorefining of copper it was at one time common to employ a cathode made of copper. However, a stainless steel cathode is now commonly employed which quickly becomes coated with copper and which from then on essentially performs as a copper cathode. The deposited copper is mechanically removed from the stainless steel cathode and the cathode reused. The copper deposited on the cathode is highly pure. Impurities which were in the anode metal fall out as a solid as the anode is dissolved and may contain useful by-products, for example, gold. Besides copper, metals purified by ER include gold, silver, lead, cobalt, nickel, tin and other metals.

Electrowinning (EW) differs from electrorefining in that the metal sought is imported into the cells via, for example, pipelines, and is already contained within the electrolyte. In the example of copper, sulfuric acid is typically employed to dissolve copper from an oxide form of copper ore and the resulting liquid, after concentration, is imported into an electrowinning cell to have the copper extracted. An anode and cathode are immersed in the electrolyte and a current is passed between them, again with the anode being positive and the cathode being negative. In electrowinning, the anode is not soluble but is made of an inert material. Typically, a lead alloy anode is used in the case of copper. The cathode may be of the same metal that is being extracted from the electrolyte or it may be of a different material. For example, in the case of copper, copper cathodes may be used although stainless steel cathodes are commonly employed which quickly become coated in copper. Under of the influence of the electric current, the metal to be won leaves the electrolyte solution and is deposited in a very pure form on the cathode. The electrolyte is changed by this process having given up a large proportion of its metal content. Besides copper, metals obtained by electrowinning include lead, gold, silver, zinc, chromium, cobalt, manganese, aluminum and other metals. For some metals, such as aluminum, the electrolyte is a molten material rather than an aqueous solution.

As an example of the voltages and current involved, in copper refining, the cell voltage is generally about 0.3V and in copper electrowinning is about 2.0V. In both cases the current density is about 300 A/m$^2$ and the area of each electrode at present is about 1 m$^2$. These figures differ considerably for different metals and widely varying current densities may be used for the same metal but the invention applies to the electrorefining and electrowinning of all metals. In ER and EW the starting point is an anode juxtaposed to a cathode in an electrolyte contained in a tank. The anodes and cathodes may be plates which hang from a supporting hanger bar. The plates may also have protrusions or lugs on both sides of the plates, which enable the plates to be hung from supporting bars, for example, power supply busbars. But many cathode plates and many anode plates may be used, interleaved, with all the anode plates connected in parallel and all the cathode plates connected in parallel contained within a single tank of electrolyte. Electrically this still looks like a single cell and in the industry it is therefore commonly called a cell. In the ER and EW industry, "cell" is almost universally used to mean a tank filled with anodes and cathodes in parallel. In the ER and EW industry, "tank" can mean the same as "cell", above, or it can mean the vessel alone, depending on the context. In tankhouses "tanks" are connected in series. A typical ER tankhouse might therefore require an electrical supply of the order of 36,000 Amps at 200 Volts.

Reference is now made to FIG. 1, which illustrates a typical tankhouse in prior art. A tankhouse 100 comprises a plurality of tanks such as tanks 110, 120 and 130. Each tank comprises one cell. A cell is composed of many cathodes such as cathodes 126A and 126B in parallel and many anodes such as anodes 124A and 124B in parallel. The cathodes in tank 110 are connected to busbar 112. The anodes in tank 120 are connected to busbar 122. Busbars are connected to a power supply such as power supply 102. An anode busbar of tank 110 is connected to a positive terminal 104 of power supply 102, whereas a cathode busbar of tank 130 is connected to a negative terminal 106 of power supply 102. In FIG. 1 tanks 110, 120 and 130 are connected in series so that cathode busbars and anode busbars are connected in adjacent tanks such as tanks 110 and 120. Power supply 102 acts as a Direct Current (DC) voltage source and the DC voltage source is connected across the series circuit formed by tanks such as tanks 110, 120 and 130 to force the desired current through tanks such as tanks 110, 120 and 130. The total current is maintained at a desired value. Ideally, the current should divide equally between the cathodes such as cathodes 126A and 126B. In practice, there is significant variation in the resistance of each cathode-current path and hence there is variation in the value of the individual cathode currents. This means in practice that the metal production process operates below optimum efficiency. Further, there may be sometimes a disruption to the operation of part of a cell when a short circuit develops between an anode plate and a cathode plate such as, for example, anode 124A and cathode 126A. This is typically due to a bump or spike of metal growing on a cathode plate and increasing in size until it connects the cathode plate with an adjacent anode plate. The spike of metal has to be physically removed to permit normal operation of the cell to continue. Another disruption to normal production can occur when an individual cathode or individual anode becomes disconnected from the electrical circuit.

Reference is now made to FIG. 2, which illustrates a cross section of an electrolysis cell 200 comprising a blade 212, which may be an anode blade or a cathode blade, in prior art.

Blade 212 is immersed in electrolyte 202. As illustrated in FIG. 2, an electrical connection to blade 212 is made through protrusions or lugs on both sides of blade 212 on the upper side of blade 212. Blade 212 may comprise or be connected to a hanger bar 210. The protrusions on both sides may also be seen to form hanger bar 210. On the right hand side in FIG. 2, right side of hanger bar 210 rests on a busbar 220 so that there is a contact area 222 between busbar 220 and hanger bar 210. Contact area 222 causes busbar 220 and hanger bar 210 to form a part of an electrical circuit (not shown). A disconnection of contact area 222 is typically caused by corrosion or burning of contact area 222 or by a foreign obstacle becoming jammed between hanger bar 210 and busbar 220. On the left hand side in FIG. 2, left side of busbar 220 rests on an insulated supporting bar 230. Supporting bar 230 may also be a busbar so that the electrode 212 is electrically connected through two paths so as to reduce the effect of a bad contact to one of the sides of hanger bar 210. A short circuit results in an unusually large amount of current flowing in cathode 126A and anode 124A shorted together. Methods conventionally employed to detect short circuits are less than ideal.

One method is to detect the overheating of the electrodes resulting from the short circuit. This is less than satisfactory because damage to the electrode, the hanger bar of the electrode or the busbar connected to the hanger bar may have resulted before the short is detected.

This method will become even less acceptable as new, expensive, high-performance anodes, are introduced into electrowinning processes. In electrowinning, inert lead anodes have been commonly used. In recent years coated titanium anodes have been increasingly adopted because of their superior properties. However, the coated titanium anodes are more expensive than lead anodes and more readily damaged by heat. It has therefore become imperative that these high-value electrodes should be protected against damage.

The problem in prior art solutions is that electrodes are not sufficiently protected from damage and that electrodes are not handled separately to determine electrical currents in individual electrodes.

SUMMARY OF THE INVENTION

An objective of the invention is to make available within the hanger bar and blade assembly an autonomous power source for the control and actuation of an electronic system for the protection of said hanger bar and blade assembly. The power source may also be used for powering a communication system which permits the transfer of data from and to the hanger bar and blade assembly. The method of control permits energy to be extracted from the main current supply to the tank and stored on the hanger bar and electrode assembly for subsequent use as an on-board power source for the local control of the hanger bar and blade assembly.

A further objective of the invention is to endow a hanger-bar and blade assembly with the capability to protect itself against situations which may cause it damage. This capability may be completely self-contained.

According to an aspect of the invention, the invention is an electrode assembly for electrolytic processing of a metal in an electrolysis cell, the electrode assembly comprising: an electrode blade comprising a metallic hanger bar portion; a first lug for supporting the metallic hanger bar portion on a first power supply bar; a second lug for supporting the metallic hanger bar portion in a horizontal position together with the first lug; an insulating piece connecting the metallic hanger bar portion to the first lug; an electrical switch unit controlling electrical current supply between the first lug and the metallic hanger bar portion based on control signals transmitted to a terminal of the electrical switch unit; a control unit comprising a memory and at least one processor configured to transmit the control signals to the terminal of the electrical switch unit; and a power storage unit configured to supply power to the control unit, the power storage unit being charged from the first lug and the metallic hanger bar portion when the electrical switch unit switches off electrical current supply between the first lug and the metallic hanger bar portion based a control signal to switch off electrical current supply.

According to a further aspect of the invention, the invention is an electrode tank comprising: a plurality of electrode assemblies, the electrodes being anodes and cathodes; and a computer unit configured to determine electrical currents between the first lugs and the metallic hanger bars portions in the plurality of electrode assemblies, to determine a difference between a sum of all cathode currents and all anode currents and a current at a central rectifier providing power supply to the electrode tank, and to cause a change in the control signals to the electrical switch units to increase or decrease electrical current supply between the first lugs and the metallic hanger bars portions in the plurality of electrode assemblies.

According to a further aspect of the invention, the invention is an electrode tank comprising: at least three anodes and at least two interleaved cathodes, the at least three anodes and the at least two interleaved cathodes being electrode blades; a busbar supplying a positive voltage or a negative voltage to at least one electrode blade; an electrical switch unit controlling electrical current supply between the busbar and the at least one electrode blade based on control signals transmitted to a terminal of the electrical switch unit; a control unit comprising a memory and at least one processor configured to transmit the control signals to the terminal of the electrical switch unit; and a power storage unit configured to supply power to the control unit, the power storage unit being charged from the busbar and the at least one electrode blade when the electrical switch unit switches off electrical current supply between the busbar and the at least one electrode blade based on a control signal to switch off electrical current supply.

According to a further aspect of the invention, the present invention provides a method of creating an on-board power supply for the electronic control and communication system of a self-protecting anode or cathode. The series semiconductor devices which control the flow between the hanger bar and the blade are momentarily turned off. While turned off, the anode-cathode voltage of the cell appears across the power semiconductor device. During this period the power semiconductor device terminals may be used as a power source to charge a storage element, which may be a capacitor. This storage element may then be used as a source of power for the electronic control and communication systems. When the voltage across the capacitor falls below a predetermined level, the power semiconductor device may again be turned off for a brief instant to recharge the capacitor.

According to a further aspect of the invention, the presence of this on-board power supply permits the techniques and technology disclosed in prior art to be applied autonomously to the hanger bar and blade assembly.

According to a further aspect of the invention, current sensing is employed within the hanger bar and blade assembly so that the development of an adverse situation can be detected and appropriate action taken to protect the electrode. This action is likely to be the turning off of the series power semiconductor device or the regulation of its ability to conduct so that the current flowing through the electrode blade is maintained at a safe level.

According to a further aspect of the invention, the autonomously-powered electronic control system on the hanger bar and blade assembly communicates measurement data collected from the assembly to a network node, which may be located in a central control room.

In one embodiment of the invention, the electrode tank may be referred to as an electrolytic cell, for example, an electrowinning cell or an electrorefining cell.

In one embodiment of the invention, the electrode tank comprises electrolyte.

In one embodiment of the invention, a blade of the electrode blade is at least partly immersed in electrolyte.

In one embodiment of the invention, the control signals comprise at least two voltages. The control signals may comprise different voltages. The voltages may be supplied to the terminal of the electrical switch unit. The terminal may be a gate. The gate may be the gate of a plurality of MOSFETs such as power MOSFETs.

In one embodiment of the invention, the control signals transmitted to the terminal of the electrical switch unit may comprise gate voltages to a plurality of power MOSFETs comprised in the electrical switch unit. The control signal to switch off electrical current supply may comprise a gate voltage to the plurality of power MOSFETs comprised in the electrical switch unit, where the gate voltage is below a threshold voltage. The gate voltages may be referred to gate-to-source voltages, where the source may be the first lug or the metallic hanger bar portion. The gate voltages may be referred to gate-to-source voltages, where the source may be the busbar or the at least one electrode blade.

In one embodiment of the invention, the electrical switch unit controlling electrical current supply between the busbar and the at least one electrode blade is placed on at least one contact surface between the busbar and the at least one electrode blade.

In one embodiment of the invention, the control signals may comprise analog or digital control signals.

In one embodiment of the invention, the power supply to the control unit from the first lug or the second lug goes through a rectifier such as a diode.

In one embodiment of the invention, the power storage unit comprises a capacitor.

In one embodiment of the invention, the power storage unit comprises a rechargeable battery.

In one embodiment of the invention, the control unit further comprises a transmitter configured to transmit messages to a remote computer and to receive messages from the remote computer, the received messages comprising at least one message to determine the control signal.

In one embodiment of the invention, the electrical switch unit comprises a plurality of Metal-Oxide-Semiconductor Field-Effect Transistors.

In one embodiment of the invention, the sources of the plurality of the Metal-Oxide-Semiconductor Field-Effect Transistors are connected to the metallic hanger bar portion, the drains of the plurality of the Metal-Oxide-Semiconductor Field-Effect Transistors are connected to the first lug and the gates of the plurality of the Metal-Oxide-Semiconductor Field-Effect Transistors are connected to the terminal of the electrical switch unit.

In one embodiment of the invention, the drains of the plurality of the Metal-Oxide-Semiconductor Field-Effect Transistors are connected to the metallic hanger bar portion, the sources of the plurality of the Metal-Oxide-Semiconductor Field-Effect Transistors are connected to the first lug and the gates of the plurality of the Metal-Oxide-Semiconductor Field-Effect Transistors are connected to the terminal of the electrical switch unit.

In one embodiment of the invention, the plurality of Metal-Oxide-Semiconductor Field-Effect Transistors are power Metal-Oxide-Semiconductor Field-Effect Transistors.

In one embodiment of the invention, the second lug supports the metallic hanger bar portion on a second power supply bar.

In one embodiment of the invention, the electrode assembly further comprises: a current measuring unit configured to measure current strength between the metallic hanger bar portion and the first lug; and the at least one processor configured to receive the measured current strength from the current measuring unit.

In one embodiment of the invention, the electrode assembly further comprises: the at least one processor configured to compare the measured current strength to a predefined threshold value and to change the control signal to limit electrical current supply between the first lug and the metallic hanger bar portion in response to the measured current strength exceeding the predefined threshold value.

In one embodiment of the invention, the predefined threshold value indicates a short circuit current.

In one embodiment of the invention, the predefined threshold value is received from a remote computer unit.

In one embodiment of the invention, the remote computer unit is configured to determine electrical currents between the first lugs and the metallic hanger bars portions in a plurality of electrode assemblies, to determine a difference between a sum of all cathode currents and all anode currents and a current at a central rectifier providing power supply to the electrode tank, to transmit a control message to the control unit based on the difference, the control message comprising the predefined threshold value.

In one embodiment of the invention, the metal is copper.

In one embodiment of the invention, the electrode is an anode.

In one embodiment of the invention, the electrode is a cathode.

In one embodiment of the invention, the electrolytic processing is electrowinning or electrorefining.

In one embodiment of the invention, by using the series power semiconductor device in the linear mode, every cathode or every anode in an ER or EW system can be made to draw an identical predetermined value of current without any outside control or need for auxiliary power supply or communication system. Hence, and for example, cathodes may be installed in an electrolysis system knowing the exact value of current that they will draw from the adjacent anodes at all times. This value of current can be preset if the electrodes do not include a communication system or may be adjusted after loading in the tank if they are endowed with a communication arrangement.

The embodiments of the invention described hereinbefore may be used in any combination with each other. Several of the embodiments may be combined together to form a further embodiment of the invention. An electrode assembly or an electrolytic tank to which the invention is related may comprise at least one of the embodiments of the invention described hereinbefore.

It is to be understood that any of the above embodiments or modifications can be applied singly or in combination to the respective aspects to which they refer, unless they are explicitly stated as excluding alternatives.

The benefit of the present invention is that it is possible to provide electrode assemblies with local control units which are easily powered from the electrodes. No separate power supply wiring is required for electrode specific control units.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE INVENTION

Reference will now be made in detail to the embodiments of the present invention, examples of which are illustrated in the accompanying drawings.

Figure 1:
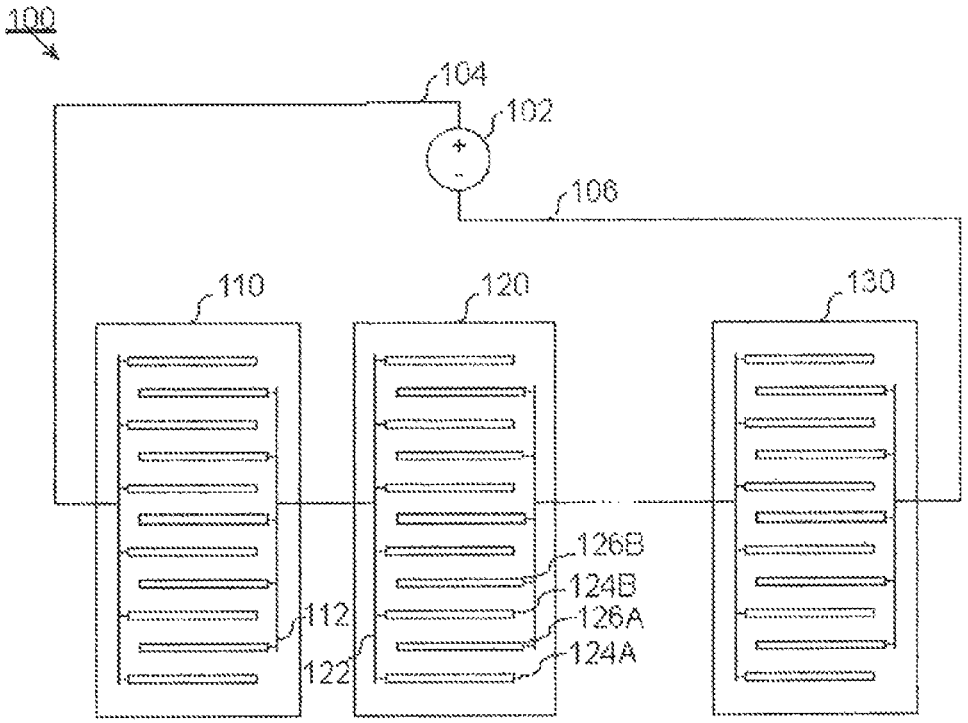
FIG. 1 (Prior Art)
FIG. 1 is a block diagram illustrating a system comprising a plurality of electrolysis cells, that is, tanks and a power source in prior art.
Figure 2:
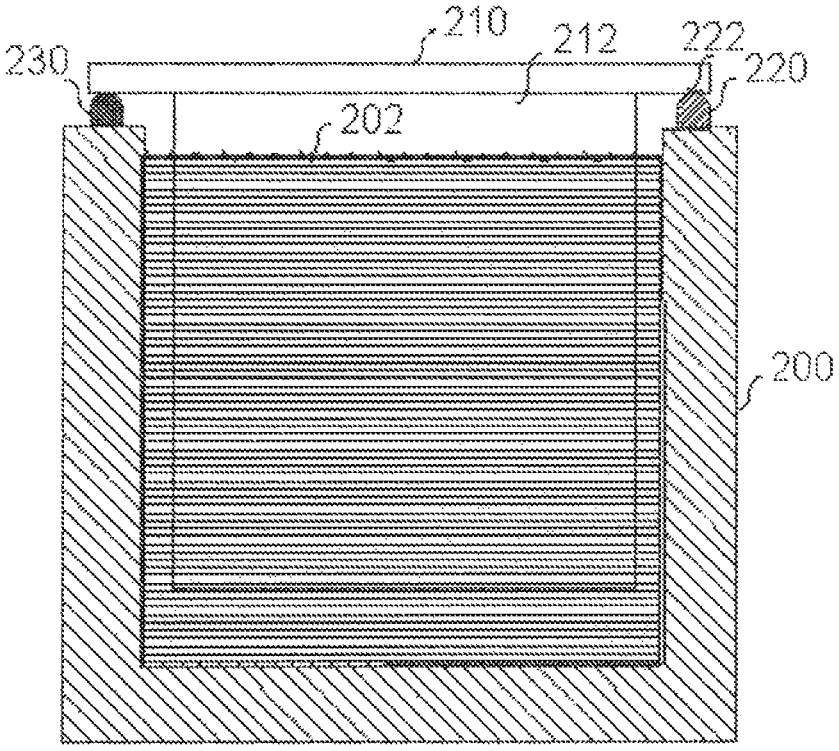
FIG. 2 (Prior Art)
FIG. 2 illustrates a cross section of an electrolysis cell comprising an anode or a cathode blade immersed in electrolyte in prior art.
Figure 3:
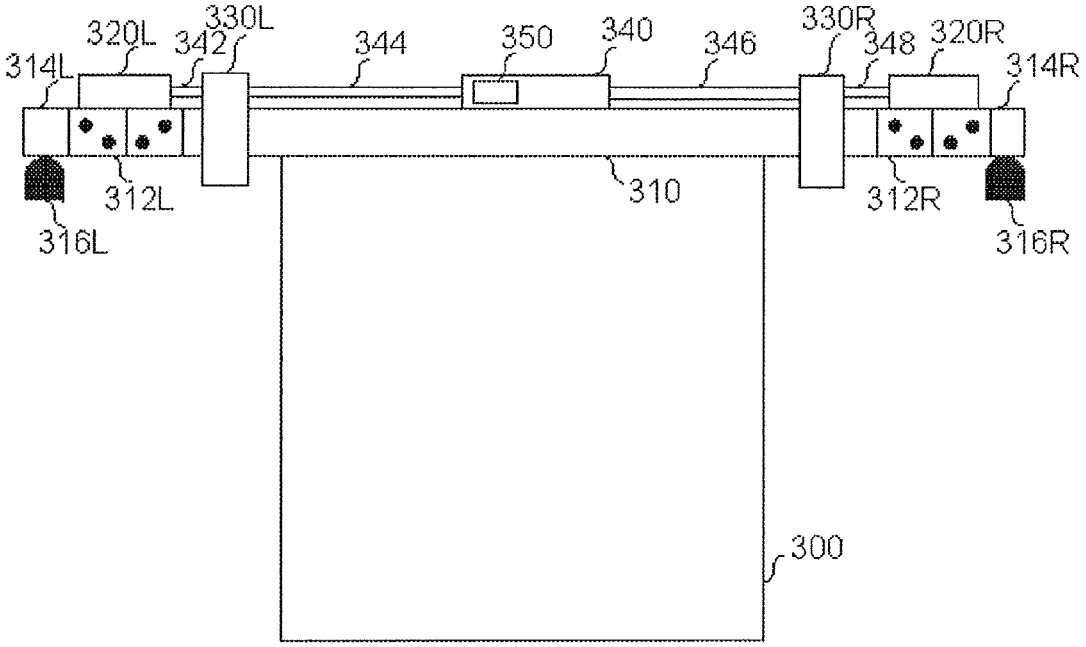
FIG. 3 illustrates an anode blade or a cathode blade supported from a hanger bar and a hanger bar assembly comprising a locally powered control unit for a double contact busbar arrangement in one embodiment of the invention.

FIG. 3 illustrates an anode blade or a cathode blade supported from a hanger bar and a hanger bar assembly comprising a locally powered control unit for a double contact busbar arrangement in one embodiment of the invention. The components in FIG. 3 are not drawn to correspond to their sizes and forms in an actual implementation. Their sizes and forms are just for illustrative purposes.

In FIG. 3 there is a blade 300, which may be an anode or a cathode of an electrolytic cell. To blade 300 is connected a hanger bar 310. Hanger bar 310 may also be formed of an upper portion of blade 300. At the left hand end of hanger bar 310 there is a conducting left lug 314L attached mechanically to hanger bar 310 through insulating connecting piece 312L. At the right hand end of hanger bar 310 there is a conducting right lug 314R attached mechanically to hanger bar 310 through insulating connecting piece 312R. Insulating connecting pieces 312L and 312R enable conducting lugs 314L and 314R to be electrically separated from hanger bar 310, but mechanically connected to a single assembly with hanger bar 310 that supports blade 300. Conducting lugs 314L and 314R are fixed to insulating connecting pieces 312L and 312R, respectively, using bolts or screws. Insulating connecting pieces 312L and 312R are fixed using bolts or screws to respective left and right ends of hanger bar 310. The arrangement in FIG. 3 may be seen to be symmetric with respect to a Y-axis (not shown) in the middle or FIG. 3, which may imply that both ends of the hanger bar 310 rest on conducting busbars. In one embodiment of the invention, only one end of a hanger bar such as hanger bar 310 rests on a conducting busbar. If blade 300 is a cathode, current passes from blade 300 to hanger bar 310. If blade 300 is an anode, current passes from hanger bar 310 to blade 300. The path of current from hanger bar 310 to busbars 316L and 316R is via respective switch units 320L and 320R and conducting lugs 314L and 314R, if blade 300 is a cathode. The path of current is in inverse direction, if blade 300 is an anode.

Because conducting lug 314L and conducting lug 314R are electrically separated from hanger bar 310, there is no fixed permanent electrical connection from conducting lug 314L and 314R to hanger bar 310. Electrical connection of lugs 314L and lug 314R to hanger bar 310 is made through respective switch units 320L and 320R. Switch units 320L and 320R are power semiconductor switches, each of which may, for example, comprise a plurality of power Metal-Oxide-Semiconductor Field-Effect Transistors (MOSFETs). Switch units 320L and 320R are controlled using respective control signals transmitted to switch units 320L and 320R. The control signal may be control voltages supplied to switch units 320L and 320R. Control voltages may be supplied to the gates of the plurality of power MOSFETs. The power MOSFETs are oriented depending on whether blade 300 is an anode or cathode to permit current to flow between lug 314L or 314R and hanger bar 310 when the power MOSFETs are in the on-state and to block such current flow when the power MOSFETs are in the off-state. Switch units 320L and 320R contain a sufficient number of power MOSFETs in parallel that the resistance of switch units 320L and 320R in the power MOSFETs on-state is very low so that when carrying the maximum desired electrode current the voltage drop across the switch units 320L and 320R is small compared with the voltage drop between the cathodes and anodes of a cell.

In one embodiment of the invention, the power MOSFETs in switch units 320L and 320R are thermally connected to a mass in the form of at least one of hanger bar 310, lug 314L and lug 314R. The thermal connection enables to sink heat from the power MOSFETs into the mass for cooling purposes since the mass is metal. The sinking of heat makes it possible to operate the power MOSFETs semiconductor devices in the linear regime and hence they can regulate the current flow in the electrode.

In FIG. 3 there is illustrated a control unit 340. The switch units 320L and 320R are connected electrically to control unit 340. Control unit 340 may comprise at least one processor and a memory. Control unit is communicatively connected to switch units 320L and 320R. Control unit 340 may also be communicatively connected to a tankhouse control unit (not shown). The connection to tankhouse control unit may be wired or wireless. In case of the connection being wireless control unit 340 may further comprise at least one antenna and a transmitter and a receiver. The at least one antenna may be housed in a cable tube such as cable tube 344 or 346. Control unit 340 may comprise a display (not shown), for example, at least one led to indicate, for example, the state of control unit 340 or current strength across switch units 320L and 320R.

In one embodiment of the invention, control unit 340 may also be communicatively connected to a plurality of voltmeters that measure a voltage drop in hanger bar 310 between two points. A first point may be located within 0-10 centimeters from the center of hanger bar 310 or substantially near the center of hanger bar 310 and a second point may be located within 0-20 centimeters from a left or right side of hanger bar 310 or substantially at the left or right end of the hanger bar 310. The plurality of voltmeters may transmit the measured voltages to control unit 340 which may use the measurements to determine current in hanger bar 310. Control unit 340 may also be communicatively connected to at least one temperature sensors arranged to measure the temperature at a location on hanger bar 310 or blade 300. Control unit 340 may be configured to transmit a control signal to switch units 320L and 320R to change resistance across switch units 320L and 320R so that correction for a change of resistance due to temperature change may be applied.

Electrical connections may be used to transmit respective control signals from control unit 340 to switch units 320L and 320R. The wires for connecting switch units 320L and 320R to control unit 340 may be housed in a cable tube such as cable tubes 342, 344, 346 and 348 to prevent damage. In one embodiment of the invention the wires may also be protected from damage by being contained in a grove or tubular canal within hanger bar 310. Control unit 340 comprises an energy storage device 350. Energy storage device 350 may comprise a capacitor, for example, foil, electrolytic, super-capacitor or ultra-capacitor. The energy storage device may also comprise a rechargeable storage battery as an alternative or a supplement to the capacitor. Control unit 340 may be electrically connected using wires to switch units 320L and 320R. The wires are used to transmit switching or other command signals from control unit 340 to switch units 320L and 320R, for example, in case of linear control. In one embodiment of the invention, both switch units 320L and 320R comprise a separate control unit similar to control unit 340. In one embodiment of the invention, lug 314L and 314R may be used as alternatives to support back up in case of contact failure between either lug 314L and busbar 316L or lug 314R and busbar 316R. This forms a two-contact system. In order to ensure in a two-contact system that the total current in blade 300 is controlled, there will need to be some form of communication between the two control units, if there are two control units. In a two contact system, the direction of current flow in the secondary, that is, not the main lug could be in either direction and in the switch unit associated with the secondary lug, the power MOSFETs are bidirectional. The power MOSFETs may be in anti-series.

In FIG. 3 there are current sensing units 330L and 330R, which may be implemented using Hall elements. Current sensing units 330L and 330R may also be implemented using open-loop or closed loop sensors that employ a magnetic circuit or using any other appropriate means for current sensing. Current sensing unit 330L is connected to control unit 340 using wires in cable tube 344. Similarly, current sensing unit 330R is connected to control unit 340 using wires in cable tube 346. Current sensing units 330L and 330R may be arranged to transmit signals indicating presence of current in hanger bar 310. Current sensing units 330L and 330R may be arranged to transmit signals indicating current strength in hanger bar 310 to control unit 340. Current sensing units 330L and 330R sense the presence of current or current strength at their respective positions around hanger bar 310 or at the surface of hanger bar 310. If current strength indicated by current sensing unit 330L or current sensing unit 330R to control unit 340 exceeds a predefined threshold value indicating short-circuit, control unit 340 may transmit a control signal to switch units 320L and 320R to turn switch units 320L and 320R off in order to protect blade 300 and hanger bar 310 from damage. If current strength indicated by current sensing unit 330L or current sensing unit 330R to control unit 340 exceeds a predefined threshold value for too high current strength for normal temperature operation or circuit protection, but not short-circuit current, control unit 340 may transmit control signals to switch units 320L and 320R to put switch unit 320L and 320R into linear mode to regulate current. In one embodiment of the invention, control unit 340 may also transmit control signals to switch units 320L and 320R to put switch unit 320L and 320R into linear mode in normal operation to limit current to a strength that is required for the electrowinning or electrorefining process to continue normally but does not consume extra energy.

Figure 4:
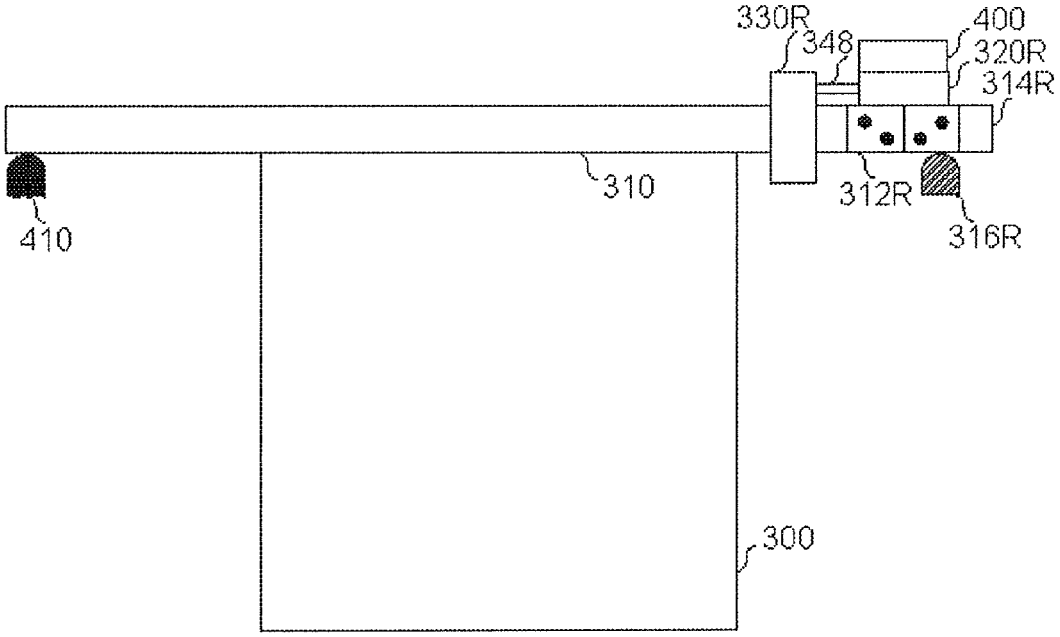
FIG. 4 illustrates an anode blade or a cathode blade supported from a hanger bar and a hanger bar assembly comprising a control unit for a single contact busbar arrangement in one embodiment of the invention.

FIG. 4 illustrates an anode blade or a cathode blade supported from a hanger bar and a hanger bar assembly comprising a control unit for a single contact busbar arrangement in one embodiment of the invention.

In FIG. 4 busbar 316L has been replaced with a physical insulating support 410. In FIG. 4 control unit 340 of FIG. 3 is co-located with switch unit 320R as control unit 400. Control unit 400 is similar to control unit 340 with the distinction of lack of switch unit 320L and current sensing unit 330L. Control unit 340 may be incorporated in same housing with switch unit 320R.

Figure 5:
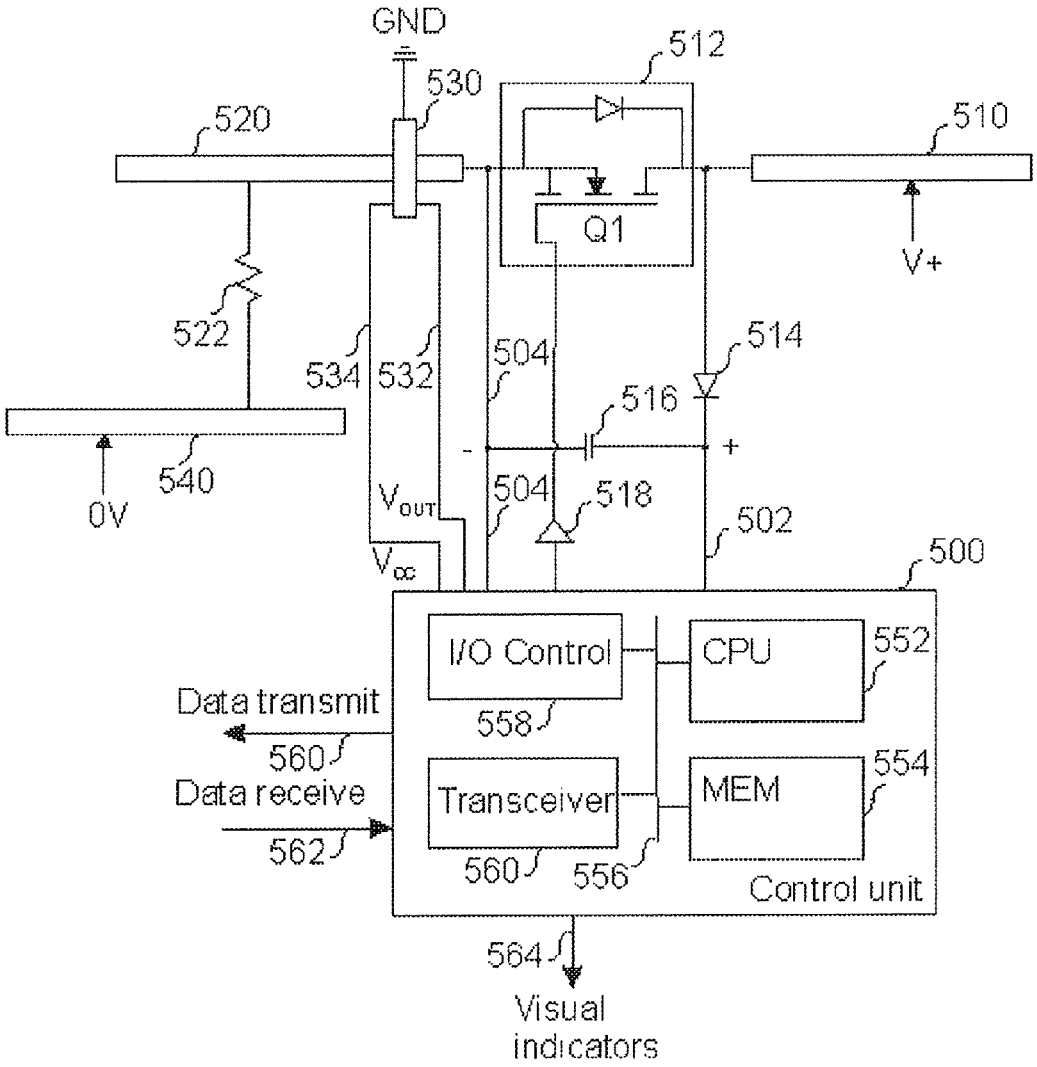
FIG. 5 illustrates an electrical circuit comprising power supply from a busbar, a power semiconductor device for switching, and an anode and a cathode, a capacitor, and a control unit with power supply from the busbar in one embodiment of the invention.

FIG. 5 illustrates an electrical circuit comprising power supply from a busbar, a power semiconductor device for switching, and an anode and a cathode, a capacitor, and a control unit with power supply from the busbar in one embodiment of the invention. FIG. 5 shows a schematic outline of the electrical connections for a single-contact system. By way of example, an anode self-protection system is illustrated. In a self-protected cathode system the direction of current flow will be reversed as will the orientation of components in the system to take account of changed voltage polarities.

In FIG. 5 there is illustrated a control unit 500. Control unit comprises at least one processor 552, a memory 554, an input-output controller 558, a transceiver 560 and a message bus 556. To transceiver 560 may be connected at least one antenna (not shown). Transceiver 560 may be configured to transmit 560 and receive 562 signals from a tankhouse control unit (not shown). Transceiver 562 may be communicatively connected to the tankhouse control unit. Control unit 500 is supplied power via terminals 502 and 504. Terminal 502 is held at a positive potential and terminal 504 is held at a negative potential. In FIG. 5 hanger bar 520 is supplied current from lug 510 through switch unit 512, referred to also as Q1. Switch unit 512 may be a power MOSFET. Lug 510 is connected to a busbar (not shown) that is a positive voltage source for lug 510. During normal electrowinning or electrorefining switch unit 512 is switched on or switch 512 is in power MOSFET linear regime. During normal operation current flows from hanger bar 520 through a resistance comprising the anode blade connected to hanger bar 520, the resistance of electrolyte and the resistance of cathode blade 540. These resistances are illustrated in FIG. 5 in the form of resistor 522. In the case of electrowinning, there is also a net over potential which opposes current flow as well as the voltage drop associated with current flow through resistance illustrated with resistor 522. Capacitor 516 is connected to negative terminal 504 and positive terminal 502. Positive terminal 502 is held at a positive potential by being connected to lug 510 which is connected to the busbar acting as positive voltage source. Negative terminal 504 is held at a negative potential by being connected to hanger bar 520 so that switch unit 512 is switched off. Capacitor 516 is the power source for the control unit 500 and possible electrical devices powered via control unit 500. Capacitor 516 is charged by momentarily turning off switch unit 512 by transmitting a switch off control signal, for example, by holding gate voltage for switch unit 512 via gate drive 518 at a voltage that causes switch unit 512 to turn off. The gate voltage to switch unit 512 may be provided via input-output controller that controls a gate driver 518 to supply gate voltage on a level determined by the at least one processor 552. As the result of switching switch unit 512 off, a voltage appears across switch unit 512. Capacitor is charged through diode 514, which prevents capacitor 516 from being discharged through switch unit 512 when switch unit 512 is switched on. An anode of diode 514 is electrically connected to lug 510, whereas a cathode of diode 514 is connected to positive terminal 502 of control unit 500. After capacitor 516 is charged, switch unit 512 is switched on so that normal operation of electrowinning or electrorefining may resume. In one embodiment of the invention, instead of diode 514 a power MOSFET may be used in the well-known manner of a synchronous rectifier in which diode 514 becomes the body-drain diode of the power MOSFET and the channel of the MOSFET is turned on when this diode is expected to be in conduction, that is, when switch unit 512 is turned off. Control unit 500 is configured to monitor the voltage across capacitor 516 and repeats the charging process when the voltage falls below a predetermined threshold voltage.

In one embodiment of the invention hanger bar 520 is provided with a current sensing unit, for example, a Hall element 530. Current sensing unit may be supplied a reference voltage $V_{CC}$ via electrical connection 534 by control unit 500. Depending on the strength of current in hanger bar 520, current sensing unit may output a current strength signal $V_{OUT}$ to control unit 500 using electrical connection 532 between current sensing unit 530 and control unit 500. Current sensing unit 530 may also be connected electrically to a ground.

Figure 6A:
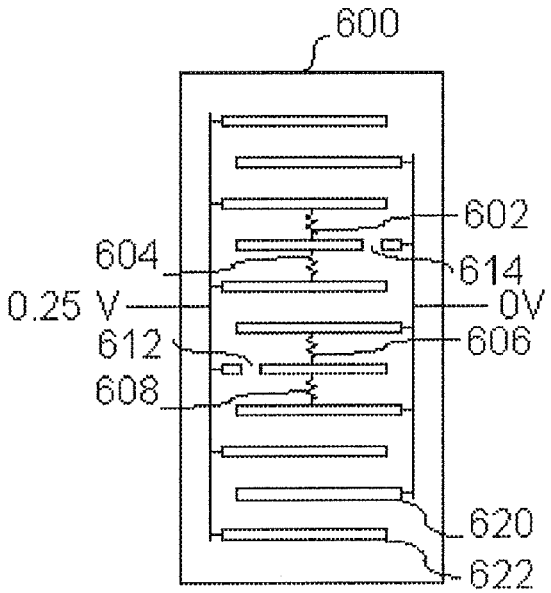
FIG. 6A illustrates voltage available for charging the capacitor of FIG. 5 in electrorefining in one embodiment of the invention.

FIG. 6A illustrates voltage available for charging the capacitor of FIG. 5 in electrorefining in one embodiment of the invention.

In FIG. 6A the cathodes such as cathode 620 are assigned a voltage of 0V. The anodes such as anode 622 are at a voltage of the order of 0.25V. A gap 614 represents an electrical isolation between a hanger bar of a cathode and the lug connected to the hanger bar. Gap 614 is bridged by a semiconductor switch unit such as switch unit 320R which is now considered to be in the off state. The floating cathode hanger bar such as hanger bar 310 is in fact connected to the anodes on either side by the electrolyte, which is illustrated by way of resistors 602, 604, 606 and 608, and a capacitor connected across gap 614 can be charged to 0.25V. In similar way, a gap 612 between an anode hanger bar and the lug connected to anode hanger bar can be charged to 0.25V. Hence anodes and cathodes in an electrorefining system may be controlled as disclosed in association with FIG. 5. The voltage of the capacitor 516 of FIG. 5 will fall as capacitor 516 is discharged. So control unit 500 will have a supply available to it in the range of, for example, 0.25V to 0.15V. It will be appreciated by those skilled in the art that this is a perfectly adequate voltage for operating a switched-mode boost converter from which may be derived supplies of a higher voltage.

Figure 6B:
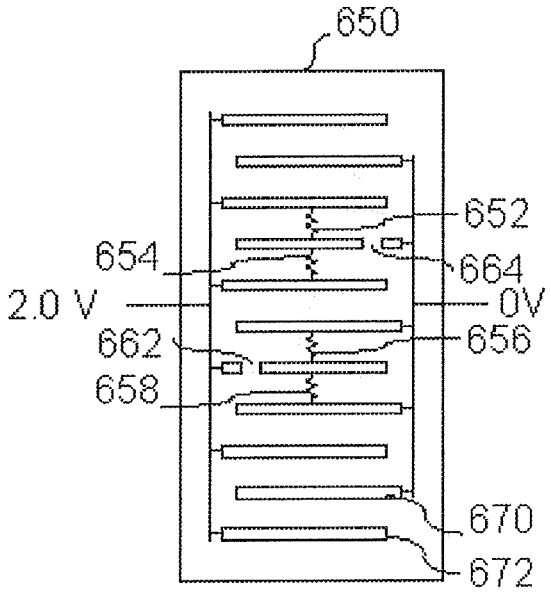
FIG. 6B illustrates voltage available for charging the capacitor of FIG. 5 in electrowinning in one embodiment of the invention.

FIG. 6B illustrates voltage available for charging the capacitor of FIG. 5 in electrowinning in one embodiment of the invention.

FIG. 6B repeats the description in association with FIG. 6A for an electrowinning system. In FIG. 6B there are cathodes such as cathode 670 connected to a cathode busbar. In FIG. 6B there are anodes such as anode 672 connected to an anode busbar. A gap 664 represents an electrical isolation between a hanger bar of a cathode and the lug connected to the hanger bar. A gap 662 represents an electrical isolation between a hanger bar of an anode and the lug connected to the hanger bar. The floating cathode hanger bar such as hanger bar 310 is connected to the anodes on either side by the electrolyte, which is illustrated by way of resistors 652, 654, 656 and 658. The main difference between FIGS. 6A and 6B is that the anodes such as anode 672 will be at a voltage of about 2.0V with respect to the cathodes such as cathode 670. Hence, 2.0V may be available across gaps 664 and 662 for charging capacitor 516. However, the anode and cathode in an electrowinning cell are of dissimilar metals and hence a net over potential will exist between the cathode and anode which will tend to diminish the voltage available so that the voltage available may be reduced to the same value as that available in the case of electrorefining. In an electrode tank in which switch unit 512 is either fully on or fully off, protection for the associated electrode is obtained by switching off switch unit 512 when current strength rises to an unacceptable level. In this case the current dropped by the electrode may be picked up by other electrodes. In one embodiment of the invention, a margin of overcurrent may be allowed on all electrodes. Without the margin there may be a cascade effect on electrodes and all electrodes will turn off.

In one embodiment of the invention, in an electrode tankhouse in which switch unit 512 operates in the linear mode to keep the electrode current constant, the sum of all the cathode currents and the sum of all the anode currents must equal the value of the current at a central rectifier providing power supply to the electrolyte tanks of the tankhouse in series. This may imply that if a cathode or anode ceases to conduct for some reason, for example, due to a bad contact between a lug and its busbar, that the target current for all the anodes and all the cathodes must be altered.

In one embodiment of the invention, the altering of target current for all anodes and cathodes in a tank is achieved by issuing a control signal from a tankhouse control unit to control units associated with electrodes such as control unit 500. Control unit 500 may then transmit a control signal to switch units such as switch unit 512, which in turn controls power MOSFET drain current in a plurality of power MOSFETs based on the control signal. The control signal may be a gate voltage for the plurality of power MOSFETs.

Figure 7:
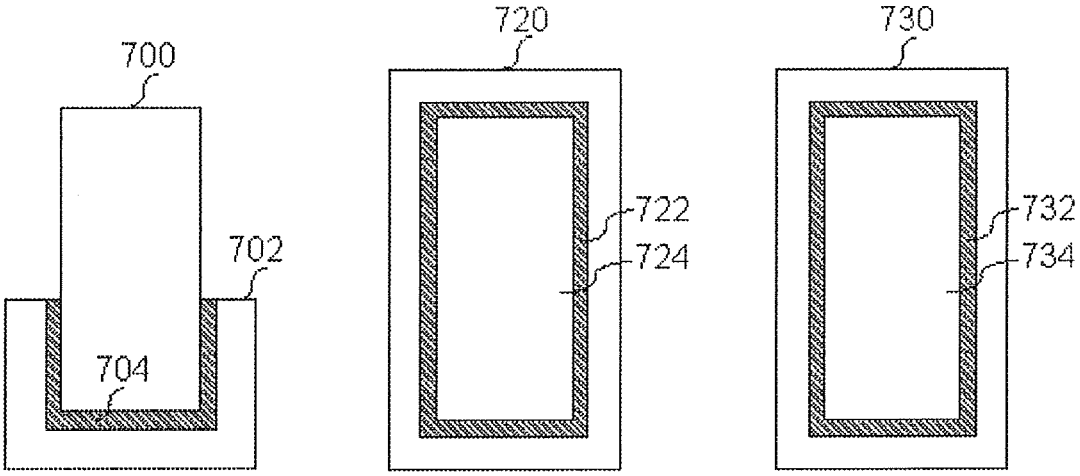
FIG. 7 shows a switch area for a shoe and cuff type of switches based on the power semiconductor device of FIG. 5 in one embodiment of the invention.

FIG. 7 shows alternative versions of a switch which does not require a split hanger bar.

In one embodiment of the invention, associated with hanger bar 700 there is a shoe 702, which has a switch area 704 that comprises a plurality of electrical switch components.

In one embodiment of the invention, associated with hanger bar 724 there is a cuff 720, which has a switch area 722 that comprises a plurality of electrical switch components.

In one embodiment of the invention, associated with hanger bar 724 there is a cuff 730, which has a switch area 732 that comprises a plurality of electrical switch components. Hanger bar 734 has a notch (not shown) cut in the hanger bar 734 to maintain hanger bar 734 is to remain at the same elevation as it occupied prior to the fitting of a shoe or cuff.

In one embodiment of the invention, the electrical switch components are controlled by a control unit such as control unit 500. The electrical switch components may be power MOSFETs.

Figure 8A:
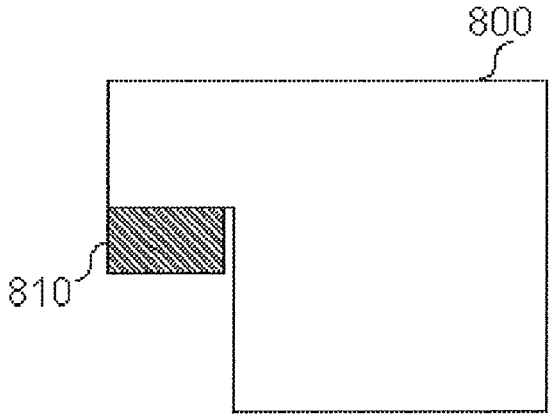
FIG. 8A shows an active-contact version of a switch based on the power semiconductor device of FIG. 5 in one embodiment of the invention.

FIG. 8A shows an active-contact version of a switch based on the power semiconductor device of FIG. 5 in one embodiment of the invention. In FIG. 8A there is a portion of hanger bar 800. Below hanger bar 800 there is a switch component area 810 comprising a plurality of electrical switch components. The switch component area 810 may be attached to hanger bar 800.

Figure 8B:
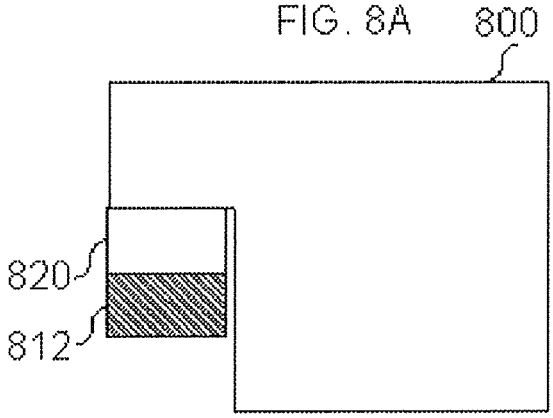
FIG. 8B shows an active-contact version of a switch based on the power semiconductor device of FIG. 5 in one embodiment of the invention.

FIG. 8B shows an active-contact version of a switch based on the power semiconductor device of FIG. 5 in one embodiment of the invention. In FIG. 8B there is a portion of hanger bar 800. There is a switch component area 812 comprising a plurality of electrical switch components. The switch component area 812 may be a layer in a busbar 820 connected electrically to hanger bar 800. Above switch component area 812 there is a layer of busbar conductive metal.

Figure 8C:
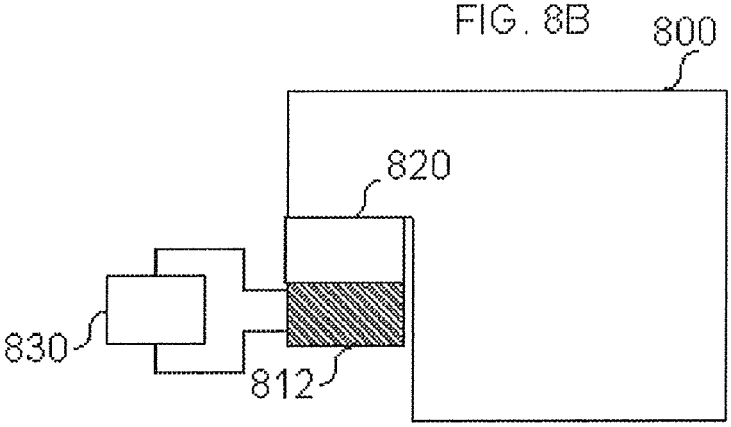
FIG. 8C shows an active-contact version of a switch based on the power semiconductor device of FIG. 5 in one embodiment of the invention.

FIG. 8C shows an active-contact version of a switch based on the power semiconductor device of FIG. 5 in one embodiment of the invention. In FIG. 8C there is a portion of hanger bar 800. In FIG. 8C switch component area 812 is controlled by a control unit 830 which is associated with an electrolyte tank (not shown). Control unit is functionally similar to control unit 500 of FIG. 5. In the embodiment of FIG. 8C the hanger bar 800 may be removed so that control unit 830 remains associated with the electrolyte tank. In this case the control circuit may be operated from a supply from the tank side rather than from a storage element located on the electrode. It will be seen that in this configuration the anodes and cathodes need no modification.

Figure 9:
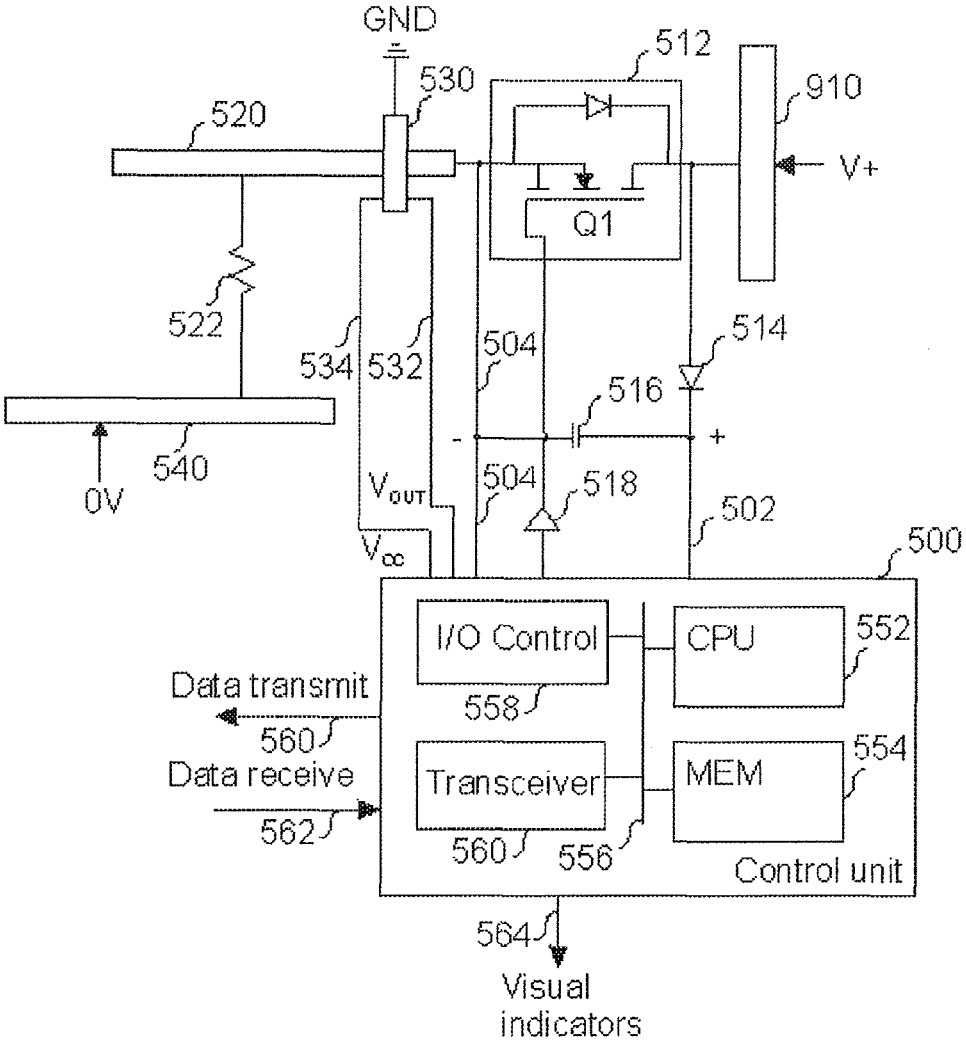
FIG. 9 illustrates an electrical circuit comprising power supply from a busbar, a power semiconductor device for switching, and an anode and a cathode, a capacitor, and a control unit with power supply from the busbar in one embodiment of the invention.

FIG. 9 illustrates an electrical circuit comprising power supply from a busbar, a power semiconductor device for switching, and an anode and a cathode, a capacitor, and a control unit with power supply from the busbar in one embodiment of the invention. In FIG. 9 the control unit 500 is supplied power from busbar 910 instead of lug 510. In FIG. 9 hanger bar 520 does not have separate electrically insulated lugs, but hanger bar 520 is directly connected to busbar 910. Switch unit 512 is arranged to be a switch component area in busbar 910 that electrical current between busbar 910 and hanger bar 520 crosses when switch unit 512 is switched on or switch 512 is in power MOSFET linear regime. The switch area is at a contact interface between busbar 910 and hanger bar 520. Switch unit 512 may be a power MOSFET. Busbar 910 is a positive voltage source in FIG. 9.

The embodiments of the invention described hereinbefore may be used in any combination with each other. Several of the embodiments may be combined together to form a further embodiment of the invention. A system or an apparatus to which the invention is related may comprise at least one of the embodiments of the invention described hereinbefore.

It is obvious to a person skilled in the art that with the advancement of technology, the basic idea of the invention may be implemented in various ways. The invention and its embodiments are thus not limited to the examples described above; instead they may vary within the scope of the claims.

The invention claimed is:

1. An electrode assembly for electrolytic processing of a metal in an electrolysis cell, the electrode assembly comprising:
   - an electrode blade comprising a metallic hanger bar portion;
   - a first lug for supporting the metallic hanger bar portion on a first power supply bar;
   - a second lug for supporting the metallic hanger bar portion in a horizontal position together with the first lug;
   - a first insulating piece mechanically connecting the first lug to the metallic hanger bar portion while keeping the first lug electrically separated from the metallic hanger bar portion;
   - a second insulating piece mechanically connecting the second lug to the metallic hanger bar portion while keeping the second lug electrically separated from the metallic hanger bar portion;
   - an electrical switch unit controlling electrical current supply between the first lug and the metallic hanger bar portion based on control signals transmitted to a terminal of the electrical switch unit;
   - a current measuring unit configured to measure current strength between the metallic hanger bar portion and the first lug;
   - a control unit comprising a memory and at least one processor configured to transmit the control signals to the terminal of the electrical switch unit to, when the current strength indicated by the current measuring unit exceeds a predefined threshold value, turn the electrical switch unit off in order to protect the electrode blade and the metallic hanger bar; and
   - a power storage unit configured to supply power to the control unit, the power storage unit being charged from the first lug and the metallic hanger bar portion when the electrical switch unit switches off electrical current supply between the first lug and the metallic hanger bar portion based on a control signal to switch off electrical current supply.

2. The electrode assembly according to claim 1, wherein the power storage unit comprises a capacitor.

3. The electrode assembly according to claim 1, wherein the power storage unit comprises a rechargeable battery.

4. The electrode assembly according to claim 1, wherein the control unit further comprises a transceiver configured to transmit messages to a remote computer and to receive messages from the remote computer, the received messages comprising at least one message to determine the control signals.

5. The electrode assembly according to claim 1, wherein the electrical switch unit comprises a plurality of Metal-Oxide-Semiconductor Field-Effect Transistors.

6. The electrode assembly according to claim 5, wherein sources of the plurality of the Metal-Oxide-Semiconductor Field-Effect Transistors are connected to the metallic hanger bar portion, drains of the plurality of the Metal-Oxide-Semiconductor Field-Effect Transistors are connected to the first lug and gates of the plurality of the Metal-Oxide-Semiconductor Field-Effect Transistors are connected to the terminal of the electrical switch unit.

7. The electrode assembly according to claim 5, wherein drains of the plurality of the Metal-Oxide-Semiconductor Field-Effect Transistors are connected to the metallic hanger bar portion, sources of the plurality of the Metal-Oxide-Semiconductor Field-Effect Transistors are connected to the first lug and gates of the plurality of the Metal-Oxide-Semiconductor Field-Effect Transistors are connected to the terminal of the electrical switch unit.

8. The electrode assembly according to claim 5, wherein the plurality of Metal-Oxide-Semiconductor Field-Effect Transistors are power Metal-Oxide-Semiconductor Field-Effect Transistors.

9. The electrode assembly according to claim 1, wherein the second lug supports the metallic hanger bar portion on a second power supply bar.

10. The electrode assembly according to claim 1, wherein the predefined threshold value indicates a short circuit current.

11. The electrode assembly according to claim 1, wherein the predefined threshold value is received from a remote computer unit.

12. The electrode assembly according to claim 11, wherein the remote computer unit is configured to determine electrical currents between the first lugs and the metallic hanger bars portions in a plurality of electrode assemblies, to determine a difference between a sum of all cathode currents and all anode currents and a current at a central rectifier providing power supply to the electrode tank, to transmit a control message to the control unit based on the difference, the control message comprising the predefined threshold value.

13. The electrode assembly according to claim 1, wherein the metal is copper.

14. The electrode assembly according to claim 1, wherein the electrode blade is an anode.

15. The electrode assembly according to claim 1, wherein the electrode blade is a cathode.

16. The electrode assembly according to claim 1, wherein the electrolytic processing is electrowinning or electrorefining.

17. An electrode tank comprising:

a plurality of electrode assemblies according to claim 1, the electrodes being anodes and cathodes; and a computer unit configured to determine electrical currents between the first lugs and the metallic hanger bars portions in the plurality of electrode assemblies, to determine a difference between a sum of all cathode currents and all anode currents and a current at a central rectifier providing power supply to the electrode tank, and to cause a change in the control signals to the electrical switch units to increase or decrease electrical current supply between the first lugs and the metallic hanger bars portions in the plurality of electrode assemblies.

* * * * *